US012595945B2

(12) United States Patent
Matsui

(10) Patent No.: US 12,595,945 B2
(45) Date of Patent: Apr. 7, 2026

(54) AIR-CONDITIONING APPARATUS

(71) Applicant: Mitsubishi Electric Corporation, Tokyo (JP)

(72) Inventor: Ryosuke Matsui, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 182 days.

(21) Appl. No.: 18/549,006

(22) PCT Filed: Apr. 20, 2021

(86) PCT No.: PCT/JP2021/016034

§ 371 (c)(1),
(2) Date: Sep. 5, 2023

(87) PCT Pub. No.: WO2022/224349

PCT Pub. Date: Oct. 27, 2022

(65) Prior Publication Data

US 2024/0302085 A1 Sep. 12, 2024

(51) Int. Cl.
*F25B 41/42* (2021.01)
*F25B 25/00* (2006.01)

(52) U.S. Cl.
CPC ..... *F25B 41/42* (2021.01); *F25B 25/005* (2013.01)

(58) Field of Classification Search
CPC ..... F25B 41/42; F25B 25/005
See application file for complete search history.

(56) References Cited

U.S. PATENT DOCUMENTS 9,746,193 B2 8/2017 Motomura et al.
2003/0167780 A1* 9/2003 Domyo ..... C09K 5/045 62/502

(Continued)

FOREIGN PATENT DOCUMENTS

JP 5972397 B2 8/2016
WO 2015/025366 A1 2/2015
WO 2017/072831 A1 5/2017

OTHER PUBLICATIONS

International Search Report of the International Searching Authority mailed Jun. 29, 2021 for the corresponding International Patent Application No. PCT/JP2021/016034 (and English translation).

(Continued)

*Primary Examiner* — David J Teitelbaum

(74) *Attorney, Agent, or Firm* — Posz Law Group, PLC

(57) ABSTRACT

An air-conditioning apparatus according to the present disclosure includes: a refrigerant cycle circuit in which a compressor, a heat-source-side heat exchanger, an expansion device, and a refrigerant-side flow passage of an inter-heat-medium heat exchanger are connected by refrigerant pipes, and refrigerant is circulated; and a heat-medium cycle circuit in which a pump, a use-side heat exchanger, and a heat-medium-side flow passage of the inter-heat-medium heat exchanger are connected by heat-medium conveying pipes, and the heat medium is circulated. An inside diameter D of each of the heat-medium conveying pipes is determined based on a capacity Q of the use-side heat exchanger connected to the heat-medium conveying pipes and a length L of at least part of each of the heat-medium conveying pipes included in the heat-medium cycle circuit, and is set to satisfy the following formula (1):

$$3(LQ^2)^{0.2} < D < 104(Q/L)^{0.5}. \quad (1)$$

8 Claims, 12 Drawing Sheets

(56) References Cited

U.S. PATENT DOCUMENTS

| | | | | |
|---|---|---|---|---|
| 2012/0297812 | A1 | 11/2012 | Takata et al. | |
| 2015/0176864 | A1* | 6/2015 | Yamashita | F25B 13/00 62/498 |
| 2018/0259219 | A1 | 9/2018 | Motomura | |
| 2019/0293417 | A1* | 9/2019 | Yamada | F24F 1/32 |

OTHER PUBLICATIONS

Extended European Search Report dated Apr. 4, 2024 issued in corresponding European patent application No. 21937846.0.
Office Action dated Sep. 19, 2025 issued in corresponding European patent application No. 21937846.0.

* cited by examiner

| L[m] | 50 | | | | |
|---|---|---|---|---|---|
| Q | 1 | 10 | 28 | 56 | 100 |
| MINIMUM PIPE DIAMETER m | 6.6 | 16.5 | 24.9 | 32.8 | 41.4 |
| MAXIMUM PIPE DIAMETER M | 14.7 | 46.5 | 77.8 | 110.1 | 174.1 |

| Q | 1 | | | | |
|---|---|---|---|---|---|
| L | 10 | 20 | 30 | 50 | 100 |
| MINIMUM PIPE DIAMETER | 4.8 | 5.5 | 5.9 | 6.6 | 7.5 |
| MAXIMUM PIPE DIAMETER | 32.9 | 23.3 | 19.0 | 14.7 | 10.4 |

AIR-CONDITIONING APPARATUS

CROSS-REFERENCE TO RELATED APPLICATION

This application is a U.S. National Stage Application of PCT/JP2021/016034 filed on Apr. 20, 2021, the contents of which are incorporated herein by reference.

TECHNICAL FIELD

The present disclosure relates to an air-conditioning apparatus in which a heat medium subjected to heat exchange with refrigerant is circulated to perform air conditioning, and in particular, to a pipe structure in which the heat medium is circulated.

BACKGROUND

An existing air-conditioning apparatus used as, for example, a variable refrigerant flow (VRF) system, includes an outdoor unit that is a heat source unit installed outdoors, an indoor unit or units installed indoors, and a relay unit that is interposed between the outdoor unit and the indoor units to connect the outdoor unit and the indoor units. The relay unit includes inter-heat-medium heat exchangers that cause heat exchange to be performed between refrigerant from the heat source unit and a heat medium to be supplied to the indoor units. The inter-heat-medium heat exchangers are connected to use-side heat exchangers in the indoor units by heat-medium conveying pipes. In the air-conditioning apparatus, the heat medium is circulated between the relay unit and the indoor units to supply cooling energy or heating energy to the use-side heat exchangers, and at the use-side heat exchangers, heat exchange is performed between the heat medium and air in an indoor space that is an air-conditioning target space, thereby performing air conditioning. The relay unit and the indoor units are connected by the heat-medium conveying pipes, and the heat medium is circulated between the relay unit and the indoor units.

Such an air-conditioning apparatus as described above includes a relay unit provided with a plurality of inter-heat-medium heat exchangers and is also capable of performing a cooling and heating mixed operation in which heating energy is supplied to one or some of a plurality of indoor units and cooling energy is supplied to the other or others of the indoor units. In such an air-conditioning apparatus, when the flow velocity of a heat medium in heat-medium conveying pipes is high, an oxide layer on an inner surface of a pipe may be separated, and when the flow velocity of the heat medium in the heat-medium conveying pipes is low, corrosion products may accumulate in the pipe. Therefore, the inside diameter of each of the heat-medium conveying pipes of the air-conditioning apparatus is set such that an appropriate flow velocity of the heat medium in the pipe can be ensured (see, for example, Patent Literature 1).

PATENT LITERATURE

Patent Literature 1: Japanese Patent No. 5972397

However, in such an air-conditioning apparatus as described above, in the case where heat-medium conveying pipes which connect inter-heat-medium heat exchangers and use-side heat exchangers are long, it takes long time before a heat medium reaches the use-side heat exchangers at the time of starting the operation of the air-conditioning apparatus, and the comfortability of an indoor space is impaired.

In addition, in the air-conditioning apparatus, in the case where the lengths of heat-medium conveying pipes are increased and a pressure loss is thus increased, the output of a pump that circulates the heat medium between a relay unit and indoor units needs to be increased, and the operation efficiency of the air-conditioning apparatus is reduced.

SUMMARY

The present disclosure is applied to solve such problems as described above and relates to an air-conditioning apparatus which improves the comfortability of an air-conditioning target space and whose operation efficiency is improved.

An air-conditioning apparatus according to an embodiment of the present disclosure includes: a refrigerant cycle circuit in which a compressor, a heat-source-side heat exchanger, an expansion device, and a refrigerant-side flow passage of an inter-heat-medium heat exchanger are connected by refrigerant pipes, and refrigerant is circulated, the inter-heat-medium heat exchanger being configured to cause heat exchange to be performed between the refrigerant and a heat medium; and a heat-medium cycle circuit in which a pump, a use-side heat exchanger, and a heat-medium-side flow passage of the inter-heat-medium heat exchanger are connected by heat-medium conveying pipes, and the heat medium is circulated. An inside diameter D of each of the heat-medium conveying pipes is determined based on a capacity Q of the use-side heat exchanger connected to the heat-medium conveying pipes and a length L of at least one of the heat-medium conveying pipes included in the heat-medium cycle circuit, and is set to satisfy the following formula (1):

$$3(LQ^2)^{0.2} < D < 104(Q/L)^{0.5}. \quad (1)$$

According to the embodiment of the present disclosure, the inside diameter of each of the heat-medium conveying pipes is set to be in an appropriate range based on the formula (1). Therefore, it is possible to reduce the amount of the heat medium and the pressure loss in the heat-medium conveying pipes, thus improving the comfortability of an air-conditioning target space and the operation efficiency of the air-conditioning apparatus regardless of the length of each of the heat-medium conveying pipes.

DETAILED DESCRIPTION

Embodiment 1

Figure 1:
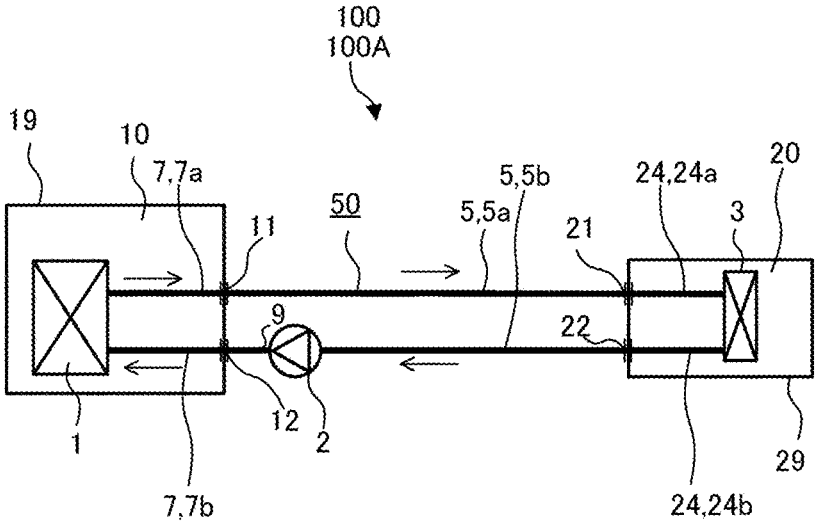
FIG. 1 is a circuit diagram of an air-conditioning apparatus 100A according to Embodiment 1.

FIG. 1 is a circuit diagram of an air-conditioning apparatus 100A according to Embodiment 1. An air-conditioning apparatus 100 will be described with reference to FIG. 1. The air-conditioning apparatus 100 as illustrated in FIG. 1 is, for example, a variable refrigerant flow (VRF) system and circulates a heat medium between a heat source unit 10 installed outdoors and an indoor unit 20 installed indoors. The heat source unit 10 includes a refrigerant cycle circuit (not illustrated) in which a compressor (not illustrated), a heat-source-side heat exchanger (not illustrated), an expansion device (not illustrated), and an inter-heat-medium heat exchanger 1 are connected by refrigerant pipes (not illustrated). In the refrigerant cycle circuit, refrigerant is circulated. The inter-heat-medium heat exchanger 1 includes a refrigerant-side flow passage connected to the refrigerant cycle circuit and a heat-medium-side flow passage connected to heat-medium conveying pipes 5. The inter-heat-medium heat exchanger 1 causes heat exchange to be performed between refrigerant and a heat medium, and causes a heat medium such as water to be heated or cooled by the refrigerant.

The inter-heat-medium heat exchanger 1 is connected to a use-side heat exchanger 3 provided in the indoor unit 20 by the heat-medium conveying pipes 5. The heat medium heated or cooled by heat exchange with the refrigerant in the inter-heat-medium heat exchanger 1 flows out from the inter-heat-medium heat exchanger 1, flows in a heat-medium conveying pipe 5*a*, and flows into the use-side heat exchanger 3 provided in the indoor unit 20. In the use-side heat exchanger 3, the heat medium exchanges heat with air in an air-conditioning target space. The heat medium then flows out from the use-side heat exchanger 3, flows into a heat-medium conveying pipe 5*b*, passes through a pump 2 connected to the heat-medium conveying pipe 5*b*, and flows into the inter-heat-medium heat exchanger 1 in the heat source unit 10. The circuit in which the heat medium is circulated will be referred to as a heat-medium cycle circuit 50. The heat medium is circulated in the heat-medium cycle circuit 50 by the pump 2.

In Embodiment 1, the heat-medium conveying pipe 5*a* connects an outlet 11 of the heat source unit 10 and an inlet 21 of the indoor unit 20. On the other hand, the heat-medium conveying pipe 5*b* connects an outlet 22 of the indoor unit 20 and the suction side of the pump 2. A discharge side of the pump 2 is connected to an inlet 12 of the heat source unit 10 by a pipe. An internal pipe 7*a* is installed between the inter-heat-medium heat exchanger 1 and the outlet 11 of the heat source unit 10. An internal pipe 7*b* is installed between the inter-heat-medium heat exchanger 1 and the inlet 12 of the heat source unit 10. The heat-medium conveying pipes 5 are connected to the respective internal pipes 7*a* and 7*b* at the outlet 11 and the inlet 12. On the other hand, an internal pipe 24*a* is installed between the use-side heat exchanger 3 and the inlet 21 of the indoor unit 20, and an internal pipe 24*b* is installed between the use-side heat exchanger 3 and the outlet 22 of the indoor unit 20. The heat-medium conveying pipes 5 are connected to the respective internal pipes 24*a* and 24*b* at the inlet 21 and the outlet 22.

Referring to FIG. 1, at outer surfaces of the heat source unit 10 and the indoor unit 20, the heat-medium conveying pipes 5 are connected to the heat source unit 10 and the indoor unit 20; however, in the inside of a housing 19 of the heat source unit 10 and the inside of a housing 29 of the indoor unit 20, the heat-medium conveying pipes 5 may be connected to the heat source unit 10 and the indoor unit 20. Alternatively, at the outside of the housing 19 and the outside of the housing 29, the heat-medium conveying pipes 5 may be connected to the heat source unit 10 and the indoor unit 20. In addition, in the heat-medium cycle circuit 50, the pump 2 may be provided at another position, and for example, may be provided in the heat source unit 10.

Heat-Medium Conveying Pipe 5

The air-conditioning apparatus 100 is, for example, a variable refrigerant flow (VRF) system, the heat source unit 10 is installed outdoors, and the indoor unit 20 is installed indoors. Thus, the lengths of the heat-medium conveying pipes 5 are appropriately set depending on the position where the indoor unit 20 is installed. That is, the lengths of the heat-medium conveying pipes 5 are appropriately changed depending on the structure of a building and the installation positions of the heat source unit 10 and the indoor unit 20. In this case, in the case where the inside diameter of each of the heat-medium conveying pipes 5 is small, a pressure loss is increased during circulation of a heat medium, thus reducing the flow rate of the heat medium in the heat-medium conveying pipe 5.

By contrast, in the case where the inside diameter of the heat-medium conveying pipe 5 is set large, the volume of the inside of the heat-medium conveying pipe 5 is large, and the amount of a heat medium in the heat-medium cycle circuit 50 is thus increased. Therefore, it takes time before a heat medium having heating energy or cooling energy generated in the inter-heat-medium heat exchanger 1 of the heat source unit 10 is supplied to the use-side heat exchanger 3 of the indoor unit 20. Therefore, desired heat exchange is not performed in the use-side heat exchanger 3, and it takes time before appropriate air conditioning is performed in an indoor space that is an air-conditioning target space. Inevitably, it is not possible to perform appropriate air conditioning in the indoor space.

In order to solve the above problem, the inside diameter of the heat-medium conveying pipes 5 of the air-conditioning apparatus 100 is set to satisfy the following formula.

$$3(LQ^2)^{0.2} < D < 104(Q/L)^{0.5} \quad (1)$$

where D is the inside diameter [mm] of the heat-medium conveying pipe 5, L is the length [m] of the heat-medium conveying pipe 5, and Q is the total capacity [kW] of the use-side heat exchangers 3.

Figure 2:
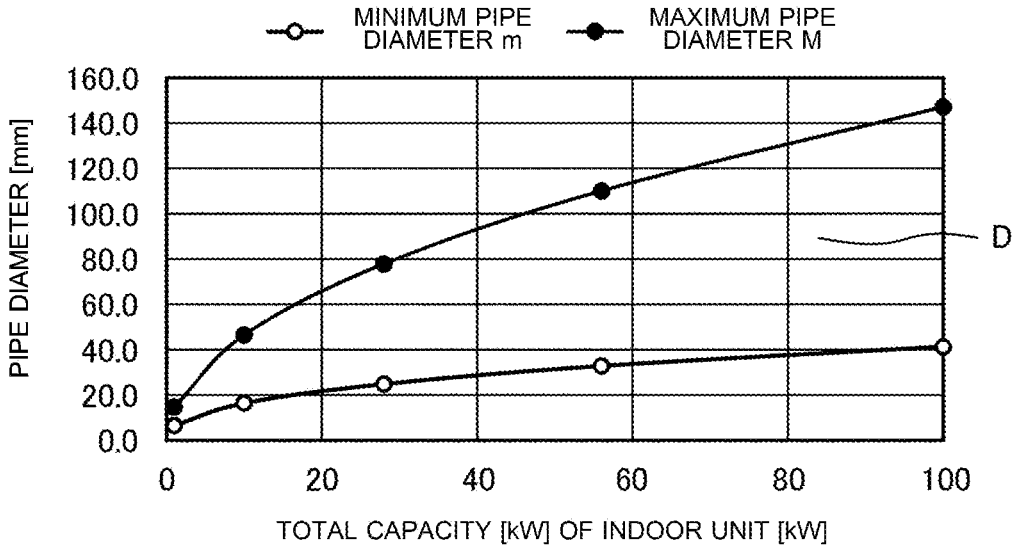
FIG. 2 indicates a set range of an inside diameter D of each of heat-medium conveying pipes 5 of an air-conditioning apparatus 100 according to Embodiment 1.

FIG. 2 indicates the set range of the inside diameter D of each of the heat-medium conveying pipes 5 of the air-conditioning apparatus 100 according to Embodiment 1. In a graph in FIG. 2, the vertical axis represents the inside diameter D of the heat-medium conveying pipe 5, and the horizontal axis represents the capacity Q of the use-side heat exchanger connected to the heat-medium conveying pipe 5. In the case where the number of use-side heat exchangers connected to the heat-medium conveying pipes 5 is two or more, the horizontal axis represents the total capacity Q of the use-side heat exchangers 3. FIG. 2 indicates a possible set range of the inside diameter D in the case where the length L of each of the heat-medium conveying pipes 5 is set to 50 m. In FIG. 2, the inside diameter D is set to fall within the range between the maximum pipe diameter indicated by a curved line M and the minimum pipe diameter indicated by a curved line m.

In the air-conditioning apparatus 100A as illustrated in FIG. 1, it is assumed that the length of part of the heat-medium conveying pipe 5*a* that is located from the outlet 11 of the heat source unit 10 to the inlet 21 of the indoor unit 20 is the length L of the heat-medium conveying pipe 5, and the capacity (power) of the use-side heat exchanger 3 of the indoor unit 20 is the capacity Q.

For example, referring to FIG. 1, when the capacity of the use-side heat exchanger 3 is 10 KW, the inside diameter D of the heat-medium conveying pipe 5*a* is set to a value that is greater than 16.5 mm and smaller than 46.5 mm. As a result, it is possible to reduce the pressure loss in the heat-medium conveying pipe 5*a* and time that is required until the use-side heat exchanger 3 starts appropriate heat exchange.

Specifically, when the length L of the heat-medium conveying pipe 5*a* in the air-conditioning apparatus 100A as illustrated in FIG. 1 is 50 m, as illustrated in FIG. 2, the inside diameter D of the heat-medium conveying pipe 5*a* is set to a value that is greater than 6.6 mm and smaller than 14.7 mm. In addition, for example, the inside diameter of the heat-medium conveying pipe 5*b* extending from the outlet 22 of the indoor unit 20 to the pump 2 is also set to the inside diameter D corresponding to that of the heat-medium conveying pipe 5*a*. In this case also, where L is the length of the heat-medium conveying pipe 5 extending from the outlet 22 to the pump 2, and Q is the total capacity of the use-side heat exchangers 3, it is necessary that the inside diameter D of the heat-medium conveying pipe 5*b* is set to fall within the range satisfying the formula (1). By virtue of such a configuration, the air-conditioning apparatus 100A can reduce the pressure loss in each of the heat-medium conveying pipes 5*a* and 5*b*, which correspond to large part of the heat-medium cycle circuit 50, in an appropriate range, and reduce the volume of each of the heat-medium conveying pipes 5*a* and 5*b* to a value which falls into an appropriate range. Thus, the air-conditioning apparatus 100A is capable of reducing the time required until the use-side heat exchanger 3 starts appropriate heat exchange, for example, when the air-conditioning apparatus 100A starts its operation or the operating conditions are changed. The air-conditioning apparatus 100A is thus capable of improving the comfortability of the air-conditioning target space. In addition, the operation efficiency of the air-conditioning apparatus 100A is improved because it is not necessary to increase the output of the pump 2.

Of the heat-medium cycle circuit 50 of the air-conditioning apparatus 100A, the internal pipes 7 of the heat source unit 10, the internal pipes 24 of the indoor unit 20, and the pipe extending from the discharge side of the pump 2 to the inlet 12 of the heat source unit 10 may be set to have the same inside diameter D as the heat-medium conveying pipes 5*a* and 5*b*. Where L is the length of each of the internal pipes 7 of the heat source unit 10, the internal pipes 24 of the indoor unit 20, and the pipe extending from the discharge side of the pump 2 to the inlet 12 of the heat source unit 10, and Q is the capacity of the use-side heat exchanger 3, the inside diameter D of each of the above pipes falls within the range indicated by the formula (1).

Figure 3:
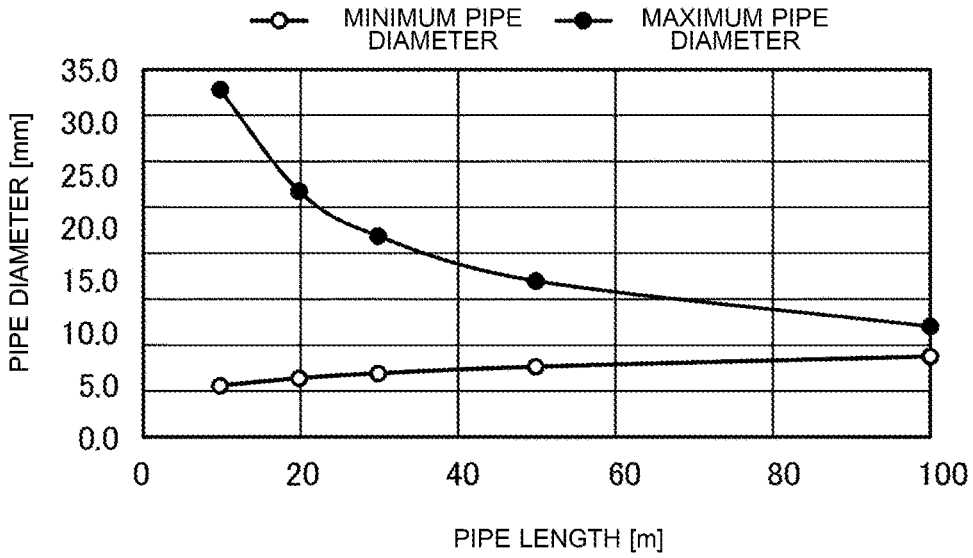
FIG. 3 indicates a set range of the inside diameter D of each of the heat-medium conveying pipes 5 of the air-conditioning apparatus 100 according to Embodiment 1.

FIG. 3 indicates the set range of the inside diameter D of the heat-medium conveying pipes 5 of the air-conditioning apparatus 100 according to Embodiment 1. In a graph in FIG. 3, the vertical axis represents the inside diameter D of each of the heat-medium conveying pipes 5, and the horizontal axis represents the length of the heat-medium conveying pipe 5. To be more specific, FIG. 3 illustrates a possible set range of the inside diameter D of each of the heat-medium conveying pipe 5 in the case the capacity Q of the use-side heat exchanger 3 is fixed at 1 KW and the length L of the heat-medium conveying pipe 5 is varied. According to FIG. 3, the greater the length L of the pipe, the smaller the possible set range of the inside diameter D of the pipe. Therefore, in the air-conditioning apparatus 100A as illustrated in FIG. 1, to the inside diameter D of a heat-medium conveying pipe 5*a* that is the longest in the heat-medium cycle circuit 50, the inside diameters of the other pipes are added, whereby the inside diameter of each of the internal pipes 7 of the heat source unit 10, the internal pipes 24 of the indoor unit 20, and a pipe 9 located at the discharge side of the pump 2, that is, the internal pipes 7, the internal pipes 24, and the pipe 9 which are included in the heat-medium cycle circuit 50, falls within the range indicated by the formula (1).

Embodiment 2

The air-conditioning apparatus 100 according to Embodiment 2 differs from the air-conditioning apparatus 100 according to Embodiment 1 in the number of indoor units 20 installed. Embodiment 2 will be described mainly regarding the differences between Embodiments 1 and 2. Regarding the air-conditioning apparatus 100 according to Embodiment 2, in each of figures, components that have the same functions as those in a previous figure or previous figures are denoted by the same reference signs.

Figure 4:
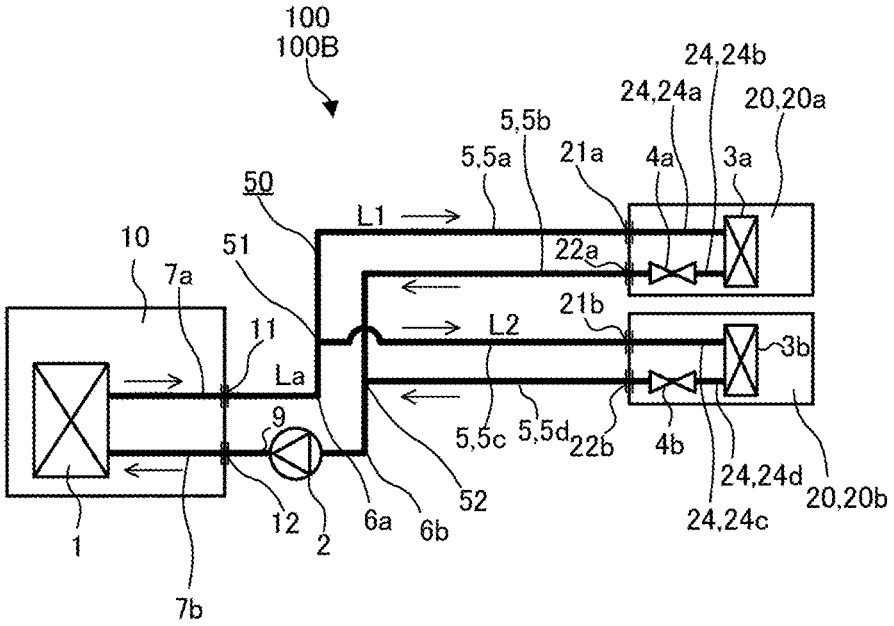
FIG. 4 is a circuit diagram of an air-conditioning apparatus 100B according to Embodiment 2.

FIG. 4 is a circuit diagram of an air-conditioning apparatus 100B according to Embodiment 2. It should be noted that the air-conditioning apparatus 100A according to Embodiment 1 includes a single indoor unit 20. By contrast, the air-conditioning apparatus 100B according to Embodiment 2 includes two indoor units 20*a* and 20*b*. Thus, in the heat-medium cycle circuit 50, a branch portion 51 is provided on the way from the heat source unit 10 toward the indoor units 20, and a joining portion 52 is provided on the way from the indoor units 20 toward the heat source unit 10.

The indoor unit 20*a* includes a use-side heat exchanger 3*a* and a flow-rate control valve 4*a*, and the indoor unit 20*b* includes a use-side heat exchanger 3*b* and a flow-rate control valve 4*b*. The flow-rate control valves 4*a* and 4*b* control the respective flow rates of heat mediums that flow into the use-side heat exchangers 3*a* and 3*b* of the heat-medium cycle circuit 50. For example, when the flow-rate control valve 4*a* as illustrated in FIG. 4 is closed and the flow-rate control valve 4*b* as illustrated in FIG. 4 is opened, in the air-conditioning apparatus 100B, the heat medium circulates only in part of the heat-medium cycle circuit 50 that is located between the heat source unit 10 and an associated one of the indoor units 20*b*, and the heat-medium cycle circuit 50 thus serves as a heat-medium cycle circuit similar to the heat-medium cycle circuit of the air-conditioning apparatus 100A according to Embodiment 1. It should be noted that use-side heat exchanger 3*a* may be referred to as a first use-side heat exchanger 3*a*, and the use-side heat exchanger 3*b* may be referred to as a second use-side heat exchanger 3*b*.

In the heat-medium cycle circuit 50 of the air-conditioning apparatus 100B according to Embodiment 2, a heat-medium conveying pipe 6*a* is connected to the outlet 11 of the heat source unit 10, and branches into two heat-medium conveying pipes 5*a* and 5*c* at the branch portion 51. The heat-medium conveying pipe 5*a* is connected to the indoor unit 20*a*, and the heat-medium conveying pipe 5*c* is connected to the indoor unit 20*b*. In addition, a heat-medium conveying pipe 5*b* connected to an outlet 22*a* of the indoor unit 20*a* and a heat-medium conveying pipe 5*d* connected to an outlet 22*b* of the indoor unit 20*b* join each other at the joining portion 52 and are connected to a heat-medium conveying pipe 6*b*. The heat-medium conveying pipe 6*b* connects the joining portion 52 and the suction side of the pump 2. The discharge side of the pump 2 is connected to the inlet 12 of the heat source unit 10.

The heat-medium conveying pipes 5*a* and 5*c* extending from the branch portion 51 to the respective indoor units 20 and the heat-medium conveying pipes 5*b* and 5*d* extending from the respective indoor units 20 to the joining portion 52 may be referred to as use-side pipes. In addition, the heat-medium conveying pipe 6*a* extending from the heat source unit 10 to the branch portion 51 and the heat-medium conveying pipe 6*b* extending from the joining portion 52 to the pump 2 may be referred to as heat-source-side pipes. Each of the use-side pipes is connected to an associated one of the use-side heat exchangers.

Heat-Source-Side Pipe

An inside diameter Da of the heat-medium conveying pipe 6*a*, which is a heat-source-side pipe, is set to fall within a range which satisfies the formula (1) when a length La from the outlet 11 of the heat source unit 10 to the branch portion 51 is substituted for the length L and a total capacity Qa of the use-side heat exchangers 3*a* and 3*b* connected to the heat-medium conveying pipes 5*a* and 5*c*, respectively, which are use-side pipes, is substituted for the capacity Q. That is, where Q1 is the capacity of the use-side heat exchanger 3*a*, and Q2 is the capacity of the use-side heat exchanger 3*b*, the set range of the inside diameter D which is obtained when Q1+Q2 is substituted for Q of the formula (1) and the pipe length La from the outlet 11 to the branch portion 51 is substituted for L of the formula (1) is a possible set range of the inside diameter Da of the heat-medium conveying pipe 6*a*, which is a heat-source-side pipe.

The inside diameter Da of the heat-medium conveying pipe 6*b*, which is the heat-source-side pipe located on the return side of the heat medium, may be set to correspond to the inside diameter Da of the heat-medium conveying pipe 6*a*. It should be noted that referring to FIG. 4, the heat-medium conveying pipe 6*a* is longer than the heat-medium conveying pipe 6*b*. Thus, as illustrated in FIG. 3, the heat-medium conveying pipe 6*b* is set to have an appropriate inside diameter when the inside diameter of the heat-medium conveying pipe 6*b* is set to correspond to the inside diameter Da of the heat-medium conveying pipe 6*a*.

Use-Side Pipe

An inside diameter D1 of the heat-medium conveying pipe 5*a*, which is a use-side pipe, is set to fall within a range that satisfies the formula (1) when the capacity Q1 of the use-side heat exchanger 3*a* connected to the heat-medium conveying pipe 5*a* is substituted for the capacity Q and a length L1 of the heat-medium conveying pipe 5*a* from the branch portion 51 to the indoor unit 20*a* is substituted for the length L. It should be noted that the heat-medium conveying pipe 5*a* connected to the first use-side heat exchanger 3*a* may be referred to as a first use-side pipe.

The inside diameter D1 of the heat-medium conveying pipe 5*b*, which is the use-side pipe located on the return side of the heat medium, may be set to correspond to the inside diameter D1 of the heat-medium conveying pipe 5*a*. It should be noted that referring to FIG. 4, of the use-side pipes, the heat-medium conveying pipe 5*a* has a length smaller than or equal to that of the heat-medium conveying pipe 5*b*. Thus, the inside diameter D1 of the heat-medium conveying pipe 5*b* is set to fall within an appropriate range when being set to be equal to the inside diameter D1 of the heat-medium conveying pipe 5*a*.

In addition, the inside diameter D2 of the heat-medium conveying pipe 5*c*, which is a use-side pipe, is set to fall within the range satisfying the formula (1) when the capacity Q2 of the use-side heat exchanger 3*b* connected to the heat-medium conveying pipe 5*c* is substituted for the capacity Q and a length L2 of the heat-medium conveying pipe 5*c* from the branch portion 51 to the indoor unit 20*b* is substituted for the length L. The heat-medium conveying pipe 5*c* connected to the second use-side heat exchanger 3*b* may be referred to as a second use-side pipe.

An inside diameter D2 of the heat-medium conveying pipe 5*d*, which is the use-side pipe located on the return side of the heat medium, may be set to correspond to the inside diameter D2 of the heat-medium conveying pipe 5*c*. Referring to FIG. 4, of the use-side pipes, the heat-medium conveying pipe 5*d* has a length smaller than or equal to that of the heat-medium conveying pipe 5*c*. Thus, the inside diameter D2 of the heat-medium conveying pipe 5*d* is set to fall within an appropriate range when being set equal to the inside diameter D2 of the heat-medium conveying pipe 5*c*.

In the air-conditioning apparatus 100B according to Embodiment 2, the heat-medium conveying pipes 5*a*, 5*c*, and 6*a* located on a feed side from the heat source unit 10 to the indoor units 20 are longer than the heat-medium conveying pipes 5*b*, 5*d*, and 6*b*, respectively, located on a return side, but this is not limiting. In the case where the heat-medium conveying pipes 5*b*, 5*d*, and 6*b* located on the return side are longer than the heat-medium conveying pipes 5*a*, 5*c*, and 6*a* located on the feed side, it suffices that the inside diameter D of each of the heat-medium conveying pipes 5 and 6 is set to fall within the range of D obtained by substituting the length of an associated one of the heat-medium conveying pipes 5*b*, 5*d*, and 6*b* located on the return side for the length L of the formula (1).

The inside diameter Da of each of the heat-medium conveying pipes 6*a* and 6*b*, which are the heat-source-side pipes, is set larger than the inside diameter D1 or D2 of each of the heat-medium conveying pipes 5*a*, 5*b*, 5*c*, and 5*d*, which are the use-side pipes. This is because the inside diameters D1 and D2 of the use-side pipes are determined depending on the capacity Q1 of one use-side heat exchanger 3, whereas the inside diameter Da of each of the heat-source-side pipes is determined depending on the total capacity Qa or Qb of the plurality of the use-side heat exchangers 3. In addition, it is appropriate that the inside diameter D of each of the internal pipes 7*a*, 7*b*, 24*a*, 24*b*, 24*c*, and 24*d* is set to correspond to that of an associated one of the heat-medium conveying pipes 5 and 6 connected thereto.

By virtue of the above configuration, in the air-conditioning apparatus 100B according to Embodiment 2 which includes a plurality of indoor units 20 or a plurality of use-side heat exchangers 3, it is possible to reduce the pressure loss in the heat-medium cycle circuit 50 and also reduce the volume of each of the heat-medium conveying pipes 5*a* and 5*b* such that the volume falls within an appropriate range. Therefore, the air-conditioning apparatus 100B reduces the time taken until the use-side heat exchangers 3 start appropriate heat exchange, for example, when the air-conditioning apparatus 100B starts its operation or the operating conditions are changed, and the air-conditioning apparatus 100B is thus improved in operation efficiency because the output of the pump 2 does not need to be increased.

Modifications

Figure 5:
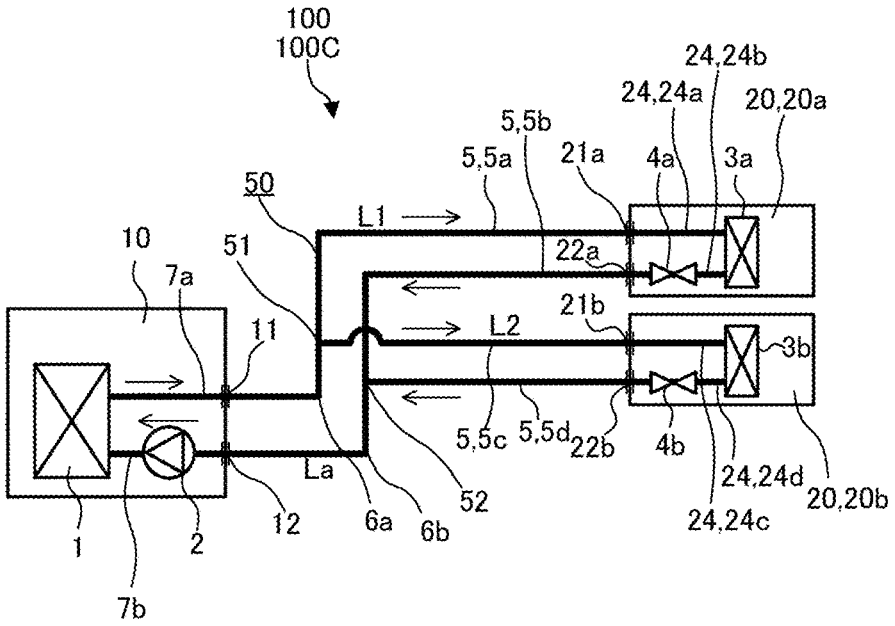
FIG. 5 is a circuit diagram of an air-conditioning apparatus 100C that is a modification of the air-conditioning apparatus 100B according to Embodiment 2.

FIG. 5 is a circuit diagram of an air-conditioning apparatus 100C that is a modification of the air-conditioning apparatus 100B according to Embodiment 2. In the air-conditioning apparatus 100C, the pump 2 of the air-conditioning apparatus 100B is provided in the heat source unit 10. Though the air-conditioning apparatus 100C has such a configuration, the inside diameter D of each of the heat-medium conveying pipes 5 and 6 can be set in the same manner as in the air-conditioning apparatus 100B. Referring to FIG. 5, the heat-medium conveying pipe 6*b*, which is a heat-source-side pipe, is longer than the heat-medium conveying pipe 6*a*. Thus, it is appropriate that the inside diameter Da of the heat-medium conveying pipe 6*b* is set to satisfy the formula (1) when the length La of the heat-medium conveying pipe 6*b*, that is, the length from the joining portion 52 to the inlet 12, is substituted for the length L of the formula (1) and the total capacity Qa of the use-side heat exchangers 3*a* and 3*b* is substituted for the capacity Q of the formula (1).

Figure 6:
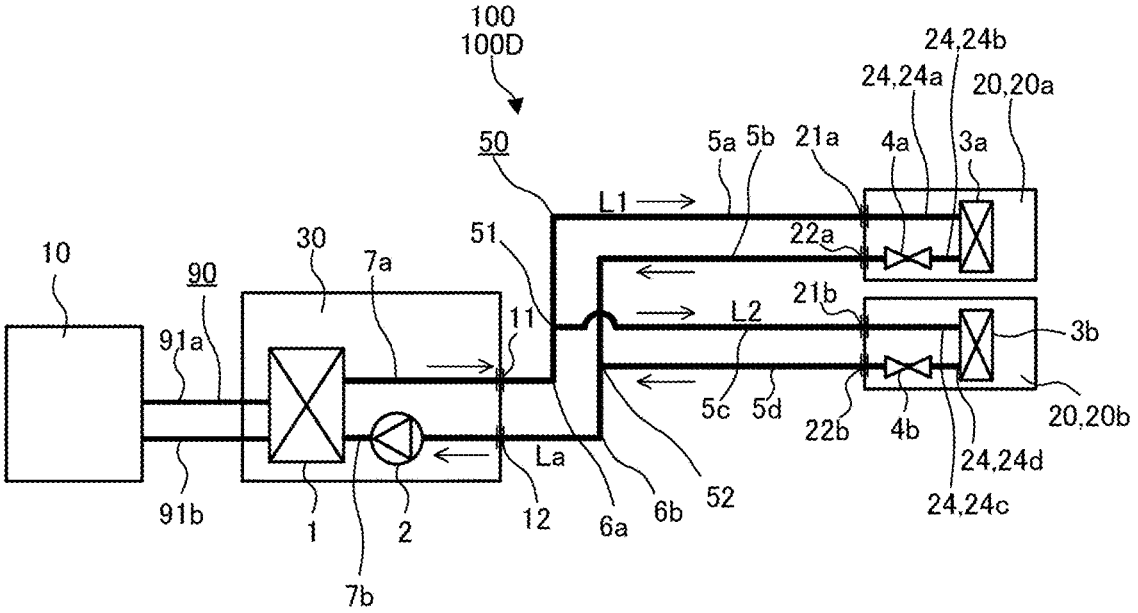
FIG. 6 is a circuit diagram of an air-conditioning apparatus 100D that is another modification of the air-conditioning apparatus 100B according to Embodiment 2.

FIG. 6 is a circuit diagram of an air-conditioning apparatus 100D that is another modification of the air-conditioning apparatus 100B according to Embodiment 2. In the air-conditioning apparatus 100D, the inter-heat-medium heat exchanger 1 is removed from the heat source unit 10 of the air-conditioning apparatus 100C and used as a relay unit 30. Thus, in the air-conditioning apparatus 100D, pipes 91*a* and 91*b* included in a refrigerant cycle circuit 90 are extended from the heat source unit 10 and connected to the inter-heat-medium heat exchanger 1 provided in the relay unit 30, whereby the refrigerant cycle circuit 90 is formed.

Also, the heat-medium cycle circuit 50 in the air-conditioning apparatus 100D including the relay unit 30 has a similar configuration to that of the air-conditioning apparatus 100C. That is, the relay unit 30 of the air-conditioning apparatus 100D corresponds to the heat source unit 10 of the air-conditioning apparatus 100C and is configured such that the heat-medium cycle circuit 50 is formed between the relay unit 30 and the indoor units 20. The inside diameter D of each of the heat-medium conveying pipes 5 and 6 included in the heat-medium cycle circuit 50 of the air-conditioning apparatus 100D can be set in a similar manner to that in the air-conditioning apparatus 100C.

Figure 7:
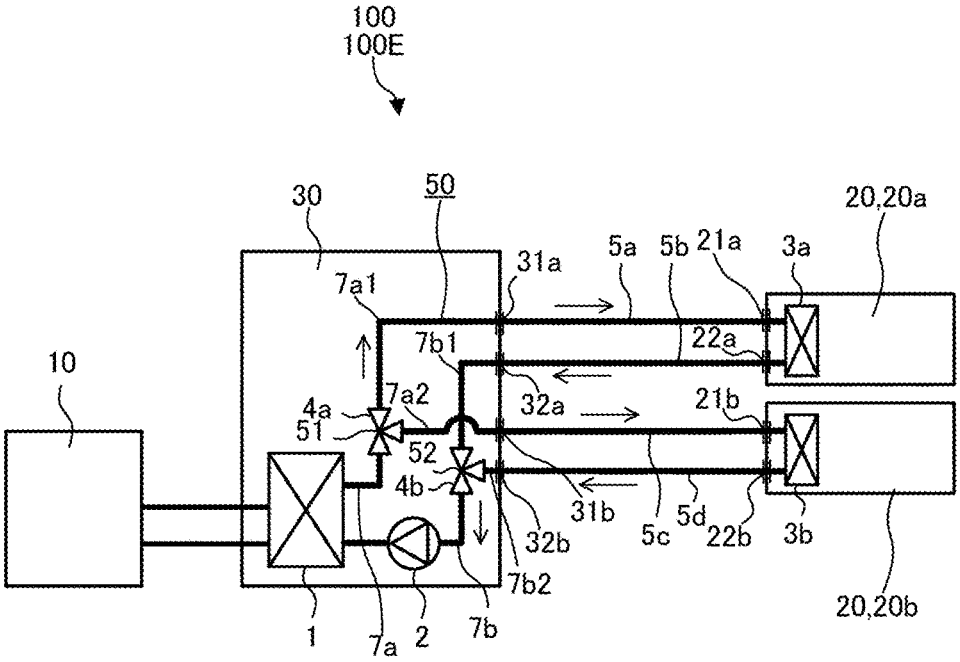
FIG. 7 is a circuit diagram of an air-conditioning apparatus 100E that is still another modification of the air-conditioning apparatus 100B according to Embodiment 2.

FIG. 7 is a circuit diagram of an air-conditioning apparatus 100E that is still another modification of the air-conditioning apparatus 100B according to Embodiment 2. The air-conditioning apparatus 100E differs from the air-conditioning apparatus 100D in the set positions of the flow-rate control valves 4*a* and 4*b*. In the air-conditioning apparatus 100E, the flow-rate control valves 4*a* and 4*b* are provided at the branch portion 51 and the joining portion 52, respectively, in the heat-medium cycle circuit 50. In addition, in the air-conditioning apparatus 100E, the branch portion 51 and the joining portion 52 of the heat-medium cycle circuit 50 are provided in the relay unit 30.

In the air-conditioning apparatus 100E, the relay unit 30 has outlets 31*a* and 31*b* and inlets 32*a* and 32*b*. The outlet 31*a* and the inlet 32*a* of the relay unit 30 are connected to the indoor unit 20*a* by the heat-medium conveying pipes 5*a* and 5*b*, respectively, and the outlet 31*b* and the inlet 32*b* of the relay unit 30 are connected to the indoor unit 20*b* by the heat-medium conveying pipes 5*c* and 5*d*, respectively. The inside diameter D1 of each of the heat-medium conveying pipes 5*a* and 5*b* can be set to satisfy the formula (1) when the length L1 of the heat-medium conveying pipe 5*a* or 5*b* is substituted for the length L and the capacity Q1 of the use-side heat exchanger 3*a* is substituted for the capacity Q. In addition, the inside diameter D2 of each of the heat-medium conveying pipes 5*c* and 5*d* can also be set on the basis of the length L2 of the heat-medium conveying pipe 5*c* or 5*d* and the capacity Q2 of the use-side heat exchanger 3*b*.

Figure 8:
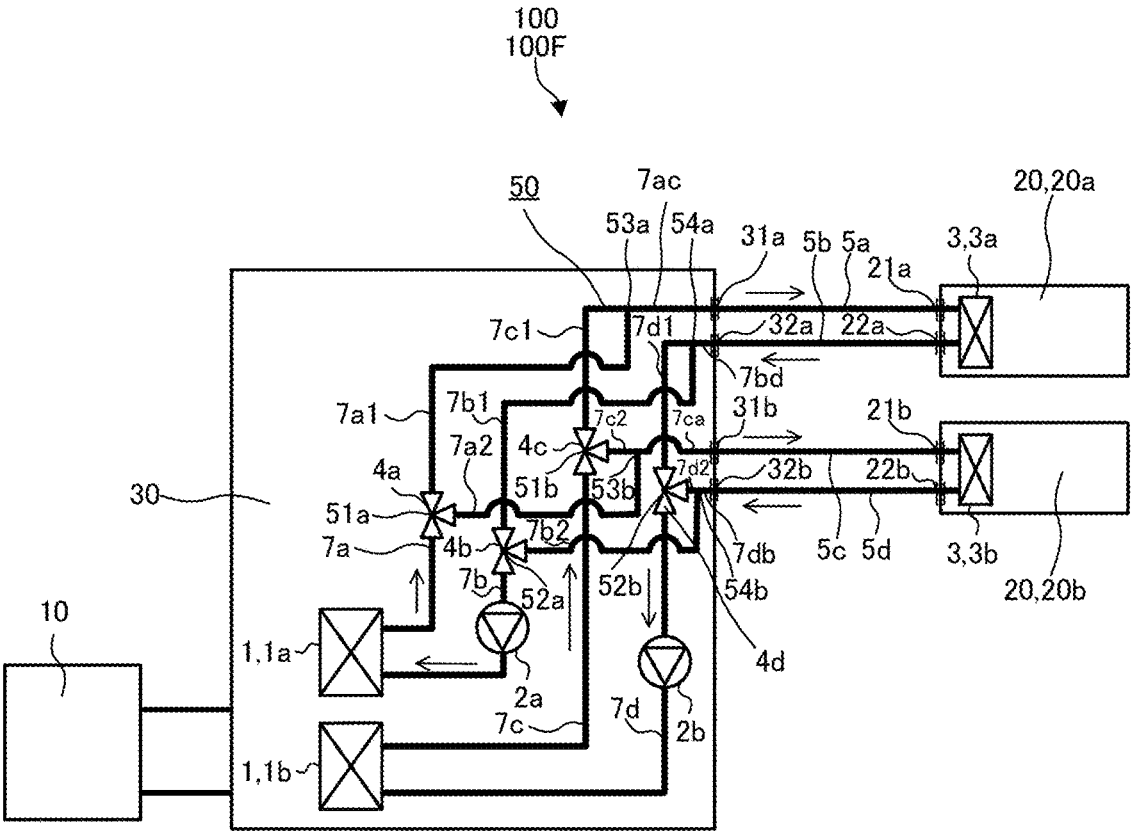
FIG. 8 is a circuit diagram of an air-conditioning apparatus 100F that is a further modification of the air-conditioning apparatus 100B according to Embodiment 2.

FIG. 8 is a circuit diagram of an air-conditioning apparatus 100F that is a further modification of the air-conditioning apparatus 100B according to Embodiment 2. The air-conditioning apparatus 100F differs from the air-conditioning apparatus 100E in that a plurality of inter-heat-medium heat exchangers 1 are mounted in the relay unit 30. The inter-heat-medium heat exchangers 1 include two inter-heat-medium heat exchangers, that is, a first inter-heat-medium heat exchanger 1*a* and a second inter-heat-medium heat exchanger 1*b*. The first inter-heat-medium heat exchanger 1*a* and the second inter-heat-medium heat exchanger 1*b* are connected to the respective use-side heat exchangers 3 in such a manner as to enable a heat medium to circulate therebetween.

The relay unit 30 includes internal pipes 7*a*, 7*b*, 7*c*, and 7*d*. The internal pipes 7*a* and 7*b* are connected to the first inter-heat-medium heat exchanger 1*a*. The internal pipes 7*c* and 7*d* are connected to the second inter-heat-medium heat exchanger 1*b*. The internal pipe 7*a* connected to the first inter-heat-medium heat exchanger 1*a* branches into internal pipes 7*a*1 and 7*a*2 at a branch portion 51*a* where the flow-rate control valve 4*a* is provided. In addition, the internal pipe 7*c* connected to the second inter-heat-medium heat exchanger 1*b* branches into internal pipes 7*c*1 and 7*c*2 at a branch portion 51*b* where a flow-rate control valve 4*c* is provided.

In the internal pipe 7*a*1, the heat medium from the first inter-heat-medium heat exchanger 1*a* flows, and in the internal pipe 7*c*1, the heat medium from the second inter-heat-medium heat exchanger 1*b* flows. The internal pipe 7*a*1 and the internal pipe 7*c*1 join each other at a joining portion 53*a* to cause the heat medium to flow out to the outside of the relay unit 30 through an internal pipe 7*ac*. On the other hand, in the internal pipe 7*a*2, the heat medium from the first inter-heat-medium heat exchanger 1*a* flows, and in the internal pipe 7*c*2, the heat medium from the second inter-heat-medium heat exchanger 1*b* flows; and the internal pipe 7*a*2 and the internal pipe 7*c*2 join each other at a joining portion 53*b* to cause the heat medium to flow out to the outside of the relay unit 30 through an internal pipe 7*ca*. The relay unit 30 has the outlets 31*a* and 31*b* which are connected to the heat-medium conveying pipes 5*a* and 5*c*, respectively. The heat medium from the relay unit 30 is supplied to the indoor units 20*a* and 20*b* through the heat-medium conveying pipes 5*a* and 5*c*.

The heat mediums from the indoor units 20*a* and 20*b* pass through the inlets 32*a* and 32*b* via the heat-medium conveying pipes 5*b* and 5*d* and flow into the relay unit 30.

The heat medium that has flowed from the use-side heat exchanger 3*a* into the relay unit 30 passes through an internal pipe 7*bd* and branches, at a branch portion 54*a*, into a heat medium that flows into an internal pipe 7*b*1 communicating with the first inter-heat-medium heat exchanger 1*a* and a heat medium that flows into an internal pipe 7*d*1 communicating with the second inter-heat-medium heat exchanger 1*b*.

The heat medium that has flowed from the use-side heat exchanger 3*b* into the relay unit 30 passes through an internal pipe 7*db* and branches, at a branch portion 54*b*, into a heat medium that flows into an internal pipe 7*b*2 communicating with the first inter-heat-medium heat exchanger 1*a* and a heat medium that flows into an internal pipe 7*d*2 communicating with the second inter-heat-medium heat exchanger 1*b*.

In the internal pipe 7*b*1, the heat medium from the use-side heat exchanger 3*a* flows, and in the internal pipe 7*b*2, the heat medium from the use-side heat exchanger 3*b* flows; the internal pipe 7*b*1 and the internal pipe 7*b*2 join each other at a joining portion 52*a* where the flow-rate control valve 4*b* is provided; and the heat medium which flows through the internal pipe 7*b*1 and the heat medium which flows through the internal pipe 7*b*2 join each other to turn into a single heat medium, and the heat medium passes through a pump 2*a* via the internal pipe 7*b* and returns to the first inter-heat-medium heat exchanger 1*a*.

In the internal pipe 7*d*1, the heat medium from the use-side heat exchanger 3*a* flows, and in the internal pipe 7*d*2, the heat medium from the use-side heat exchanger 3*b* flows; the internal pipe 7*d*1 and the internal pipe 7*d*2 join at a joining portion 52*b* where a flow-rate control valve 4*d* is provided; and the heat medium which flows through the internal pipe 7*d*1 and the heat medium which flows through the internal pipe 7*d*2 join each other to turn into a single heat medium, and the heat medium passes through a pump 2*b* via the internal pipe 7*d* and returns to the second inter-heat-medium heat exchanger 1*b*.

As described above, the air-conditioning apparatus 100F is configured to cause the heat mediums from the inter-heat-medium heat exchangers 1 to branch off and join each other in the relay unit 30, and can selectively supply the heat mediums from the inter-heat-medium heat exchangers 1 to the use-side heat exchangers 3. Therefore, one or more of the use-side heat exchangers 3 can be used in the heating operation and the other or others of the use-side heat exchangers 3 can be used in the cooling operation.

The inside diameter D1 of each of the heat-medium conveying pipes 5*a* and 5*b* of the air-conditioning apparatus 100F can be set to satisfy the formula (1) when the length L1 of the heat-medium conveying pipe 5*a* or 5*b* is substituted for the length L and the capacity Q1 of the use-side heat exchanger 3*a* is substituted for the capacity Q, as in the air-conditioning apparatus 100E. In addition, the inside diameter D2 of each of the heat-medium conveying pipes 5*c* and 5*d* of the air-conditioning apparatus 100F can also be set on the basis of the length L2 of the heat-medium conveying pipe 5*c* or 5*d* and the capacity Q2 of the use-side heat exchanger 3*b*.

In addition, it is appropriate that the inside diameter of each of the internal pipes 7*a*, 7*b*, 7*c*, 7*d*, 7*a*1, 7*a*2, 7*b*1, 7*b*2, 7*c*1, 7*c*2, 7*d*1, 7*d*2, 7*ac*, 7*bd*, 7*ca*, and 7*db* in the relay unit 30 of the air-conditioning apparatus 100F is set to fall within the range of the inside diameter D which is obtained by substituting the length of the internal pipe for L of the formula (1) and substituting the capacity of each of the use-side heat exchangers 3 which is connected to the pipe for Q of the formula (1).

In the air-conditioning apparatuses 100B to 100F according to Embodiment 2, the inside diameter of the internal pipe 7*a*, 7*b*, 7*c*, 7*d*, 7*a*1, 7*a*2, 7*b*1, 7*b*2, 7*c*1, 7*c*2, 7*d*1, or 7*d*2 in the heat source unit 10 or the relay unit 30 may be set to correspond to the inside diameter D of each of the heat-medium conveying pipes 5 or 6 as in Embodiment 1. The heat-medium conveying pipes 5 and 6 and the internal pipes 7 are each set to have an appropriate inside diameter D, whereby the air-conditioning apparatuses 100B to 100E can reduce the output of the pump while reducing the time required until the use-side heat exchangers 3 start appropriate heat exchange, and can improve the efficiency.

Embodiment 3

An air-conditioning apparatus 100 according to Embodiment 3 differs from the air-conditioning apparatuses 100 according to Embodiment 2 in the number of relay units 30 installed. Embodiment 3 will be described mainly regarding the differences between Embodiments 2 and 3. Regarding the air-conditioning apparatus 100 according to Embodiment 3, in each of the figures, components that have the same functions as a previous figure or previous figures relating to each of Embodiments 1 and 2 are denoted by the same reference signs.

Figure 9:
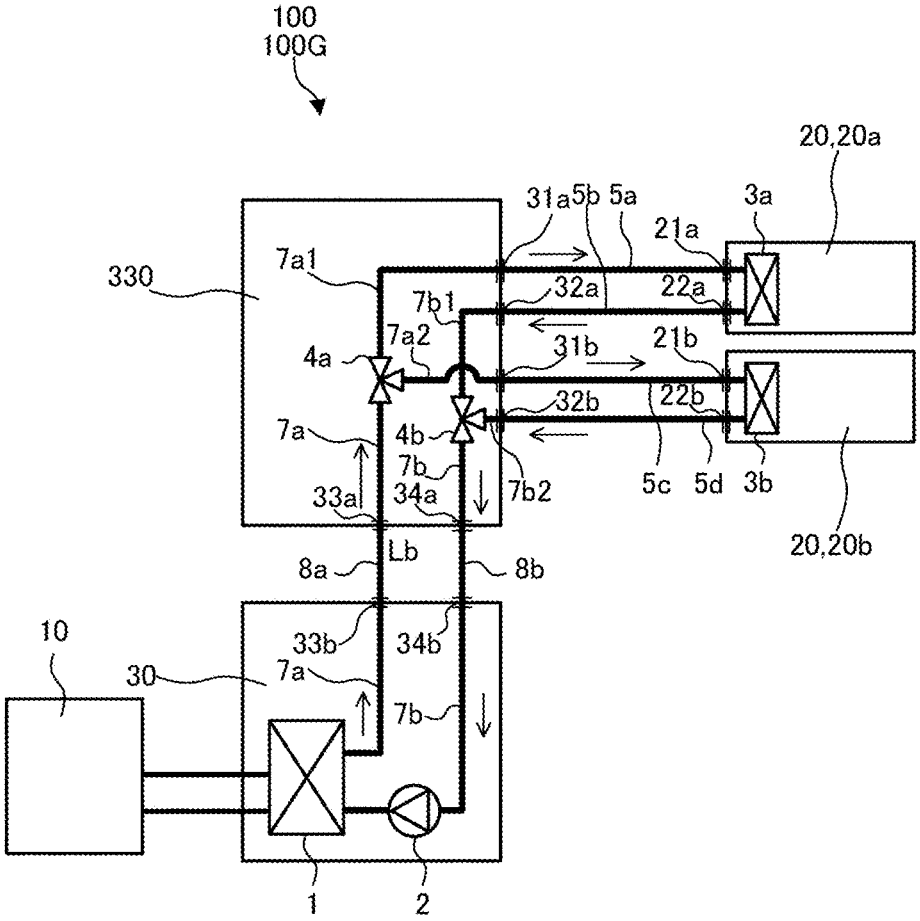
FIG. 9 is a circuit diagram of an air-conditioning apparatus 100G according to Embodiment 3.

FIG. 9 is a circuit diagram of an air-conditioning apparatus 100G according to Embodiment 3. In the air-conditioning apparatus 100G, elements closer to the indoor units 20 are removed from the branch portion 51 and the joining portion 52 of the relay unit 30 of the air-conditioning apparatus 100E as illustrated in FIG. 7 relating to Embodiment 2 and are used in an auxiliary relay unit 330. In such a manner, the relay units are separated from each other. Therefore, the air-conditioning apparatus 100G can be configured such that the relay unit 30 and the auxiliary relay unit 330 are small, and the air-conditioning apparatus 100G can be easily installed.

The relay unit 30 and the auxiliary relay unit 330 of the air-conditioning apparatus 100G are installed apart from each other. Therefore, intermediate pipes 8*a* and 8*b*, which are heat-medium conveying pipes set between the relay unit 30 and the auxiliary relay unit 330, may be long. Thus, an inside diameter Db of each of the intermediate pipes 8*a* and 8*b* is set on the basis of the formula (1) in the same manner as the inside diameter of each of the heat-medium conveying pipes 5 and 6 described regarding Embodiments 1 and 2.

As illustrated in FIG. 9, the intermediate pipes 8*a* and 8*b* are each connected to both the use-side heat exchangers 3*a* and 3*b*. Thus, the set range of the inside diameter D which is obtained when a total capacity Qb (=Q1+Q2) of the use-side heat exchangers 3*a* and 3*b* connected to the auxiliary relay unit 330 is substituted for Q of the formula (1) and a pipe length Lb from an outlet 33*b* to an inlet 33*a* is substituted for L of the formula (1) is a possible set range of the inside diameter Db of the intermediate pipe 8*a*. The inside diameter Db of the intermediate pipe 8*b* located on the return side of a heat medium may also be set on the basis of the formula (1) or may be set to correspond to the inside diameter Da of the intermediate pipe 8*a* located on the feed side of the heat medium.

As described above, the air-conditioning apparatus 100G includes the auxiliary relay unit 330 and the flexibility in the installation of the air-conditioning apparatus 100G in a building can thus be improved. In addition, in the air-conditioning apparatus 100G, the inside diameter Db of the intermediate pipes 8*a* and 8*b* connecting the relay unit 30 and the auxiliary relay unit 330 is set to an appropriate inside diameter on the basis of the formula (1), whereby it is possible to reduce the output of the pump while reducing the time required until the use-side heat exchangers 3 start appropriate heat exchange, and to improve the operation efficiency.

The inside diameter Db of each of the intermediate pipes 8*a* and 8*b* is set larger than the inside diameter D1 or D2 of each of the heat-medium conveying pipes 5*a*, 5*b*, 5*c*, and 5*d*, which are the use-side pipes. This is because the inside diameters D1 and D2 of the use-side pipes are determined depending on the capacity Q1 of one use-side heat exchanger 3, whereas the inside diameter Db of each of the intermediate pipes 8*a* and 8*b* is determined depending on the total capacity Qa or Qb of the use-side heat exchangers 3. In addition, the heat-medium conveying pipes 5*a*, 5*b*, 5*c*, and 5*d* of the air-conditioning apparatus 100G are set to satisfy the formula (1) as in Embodiments 1 and 2.

Modifications

Figure 10:
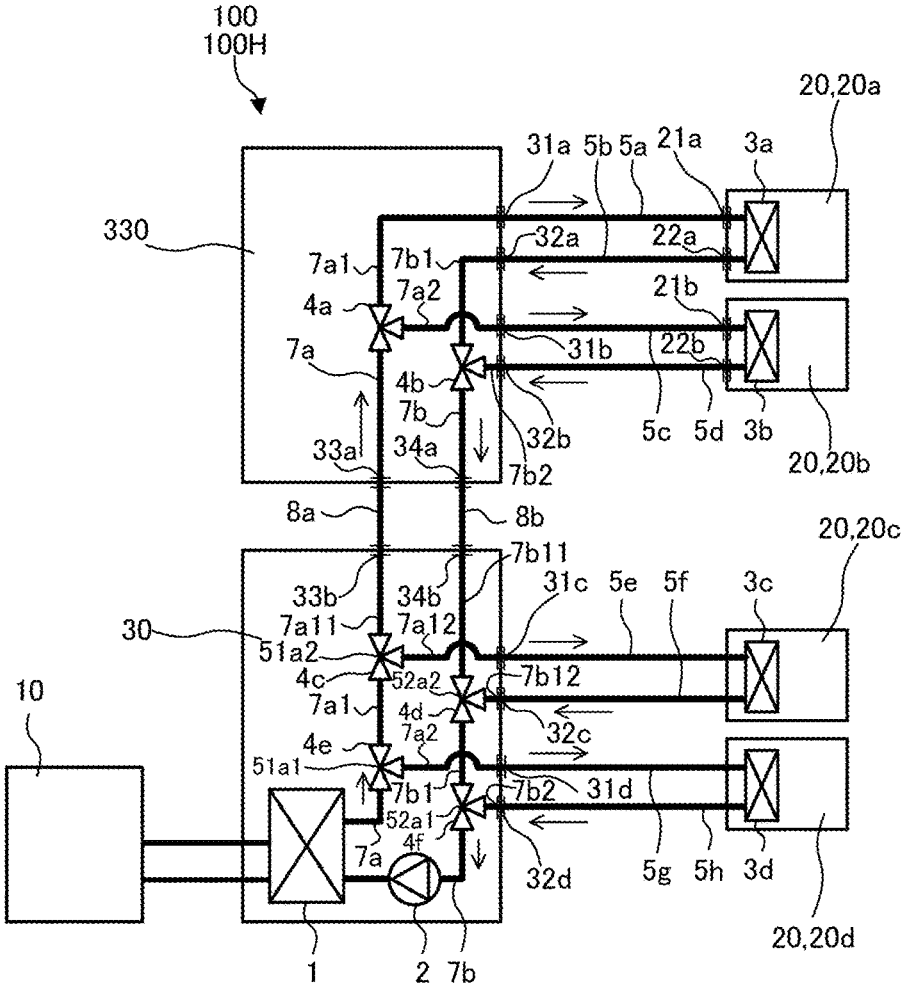
FIG. 10 is a circuit diagram of an air-conditioning apparatus 100H that is a modification of the air-conditioning apparatus 100G according to Embodiment 3.

FIG. 10 is a circuit diagram of an air-conditioning apparatus 100H that is a modification of the air-conditioning apparatus 100G according to Embodiment 3. In the air-conditioning apparatus 100H, indoor units 20*c* and 20*d* are added to the air-conditioning apparatus 100G described above and are connected to the relay unit 30.

At a branch portion 51*a*1, the internal pipe 7*a* connected to the inter-heat-medium heat exchanger 1 branches into the internal pipe 7*a*1 and the internal pipe 7*a*2 which extend toward the indoor unit 20*d*. At a branch portion 51*a*2, the internal pipe 7*a*1 branches into an internal pipe 7*a*11 extending toward the auxiliary relay unit 330 and an internal pipe 7*a*12 extending toward the indoor unit 20*c*.

Furthermore, an internal pipe 7*b*11 through which a heat medium returns from the auxiliary relay unit 330 and an internal pipe 7*b*12 through which the heat medium returns from the indoor unit 20*c* to the relay unit 30 join each other at a joining portion 52*a*2, thereby forming the internal pipe 7*b*1. In addition, the internal pipe 7*b*1 and the internal pipe 7*b*2 through which the heat medium returns from the indoor unit 20*d* join each other, thereby forming the internal pipe 7*b*. The heat medium passes through the pump 2 via the internal pipe 7*b* and returns to the inter-heat-medium heat exchanger 1.

The auxiliary relay unit 330 of the air-conditioning apparatus 100H has a similar configuration to that of the auxiliary relay unit 330 of the air-conditioning apparatus 100G.

In the air-conditioning apparatus 100H, the relay unit 30 and the auxiliary relay unit 330 are connected by the intermediate pipes 8*a* and 8*b* as in the air-conditioning apparatus 100G. The inside diameter Db of each of the intermediate pipes 8*a* and 8*b* of the air-conditioning apparatus 100H is also set to an appropriate inside diameter using the formula (1).

The heat-medium conveying pipes 5*a*, 5*b*, 5*c*, 5*d*, 5*e*, 5*f*, 5*g*, and 5*h* of the air-conditioning apparatus 100H are set to satisfy the formula (1) as in Embodiments 1 and 2.

Figure 11:
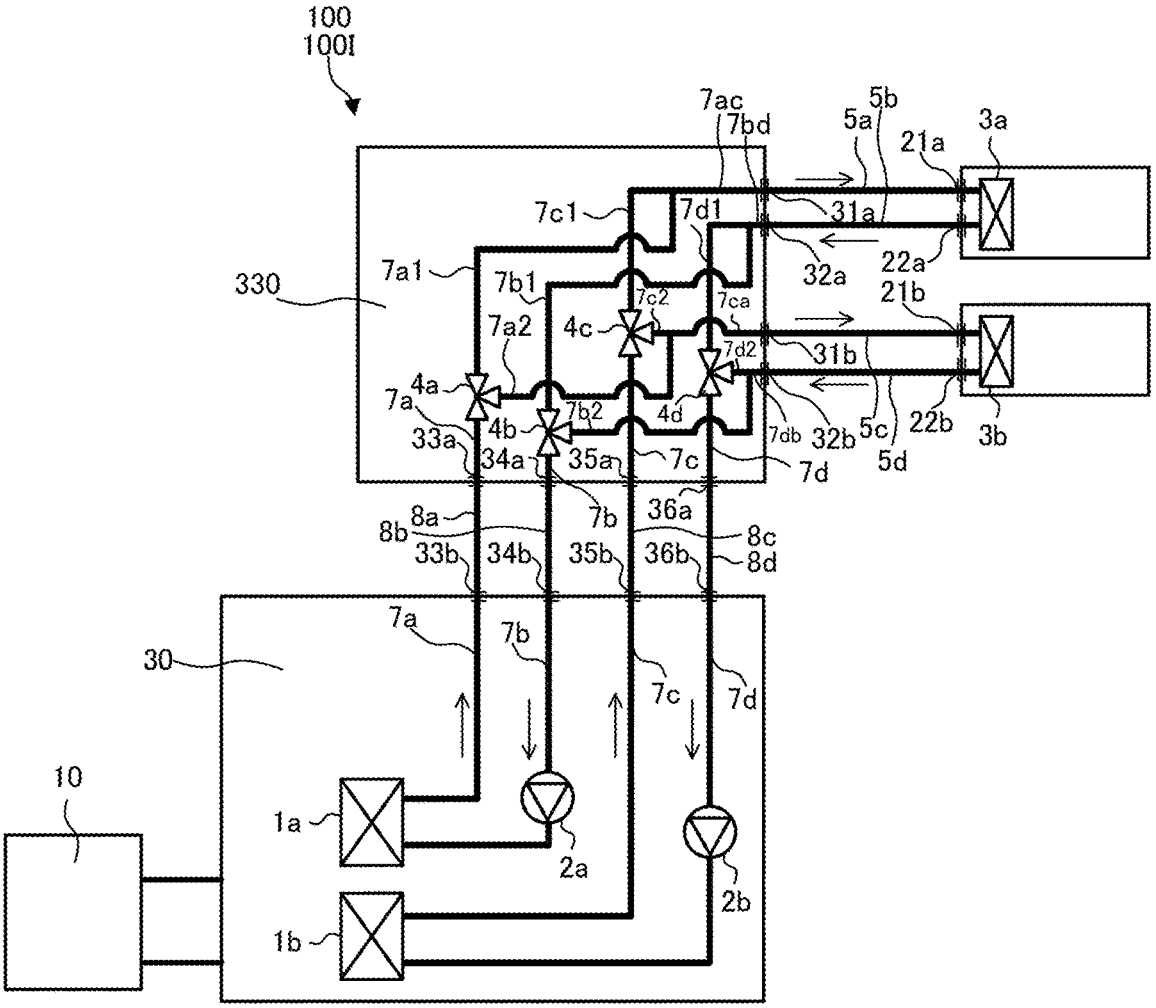
FIG. 11 is a circuit diagram of an air-conditioning apparatus 100I that is another modification of the air-conditioning apparatus 100G according to Embodiment 3.

FIG. 11 is a circuit diagram of an air-conditioning apparatus 100I that is another modification of the air-conditioning apparatus 100G according to Embodiment 3. In the air-conditioning apparatus 100I, a plurality of inter-heat-medium heat exchangers 1 are provided in the relay unit 30 of the air-conditioning apparatus 100G, whereas in the air-conditioning apparatus 100G, only one inter-heat-medium heat exchanger 1 is provided in the relay unit 30. In addition, in the air-conditioning apparatus 100I, elements closer to the indoor units 20*a* and 20*b* are removed from the branch portion 51*a*, the joining portion 52*a*, the branch portion 51*b*, and the joining portion 52*b* of the relay unit 30 of the air-conditioning apparatus 100F according to Embodiment 2 as illustrated in FIG. 8 and are used in the auxiliary relay unit 330.

The relay unit 30 and the auxiliary relay unit 330 of the air-conditioning apparatus 100I are connected by the intermediate pipes 8*a*, 8*b*, 8*c*, and 8*d*. The inside diameter Db of each of the intermediate pipes 8*a*, 8*b*, 8*c*, and 8*d* is set to an appropriate inside diameter based on the formula (1) in the same manner as an inside diameter Db of each of the intermediate pipes 8*a* and 8*b* of the air-conditioning apparatus 100G.

The intermediate pipes 8*a*, 8*b*, 8*c*, and 8*d* are each connected to both the use-side heat exchangers 3*a* and 3*b*. Thus, the set range of the inside diameter D which is obtained when the total capacity Qb (=Q1+Q2) of the use-side heat exchangers 3*a* and 3*b* connected to the auxiliary relay unit 330 is substituted for Q of the formula (1) and the pipe length Lb from the outlet 33*b* to the inlet 33*a* is substituted for L of the formula (1) is a possible set range of the inside diameter Db of the intermediate pipe 8*a*. In addition, the inside diameter of Db of the intermediate pipe 8*c*, to which a heat medium is sent from the second inter-heat-medium heat exchanger 1*b*, is also set in the same manner as in the intermediate pipe 8*a*. Furthermore, the inside diameter Db of each of the intermediate pipes 8*b* and 8*d* located on the return side of the heat medium may also be set on the basis of the formula (1) or may be set to correspond to the inside diameter Da of each of the intermediate pipes 8*a* and 8*c* located on the feed side of the heat medium.

The heat-medium conveying pipes 5*a*, 5*b*, 5*c*, and 5*d* of the air-conditioning apparatus 100I are set to satisfy the formula (1) as in Embodiments 1 and 2.

Figure 12:
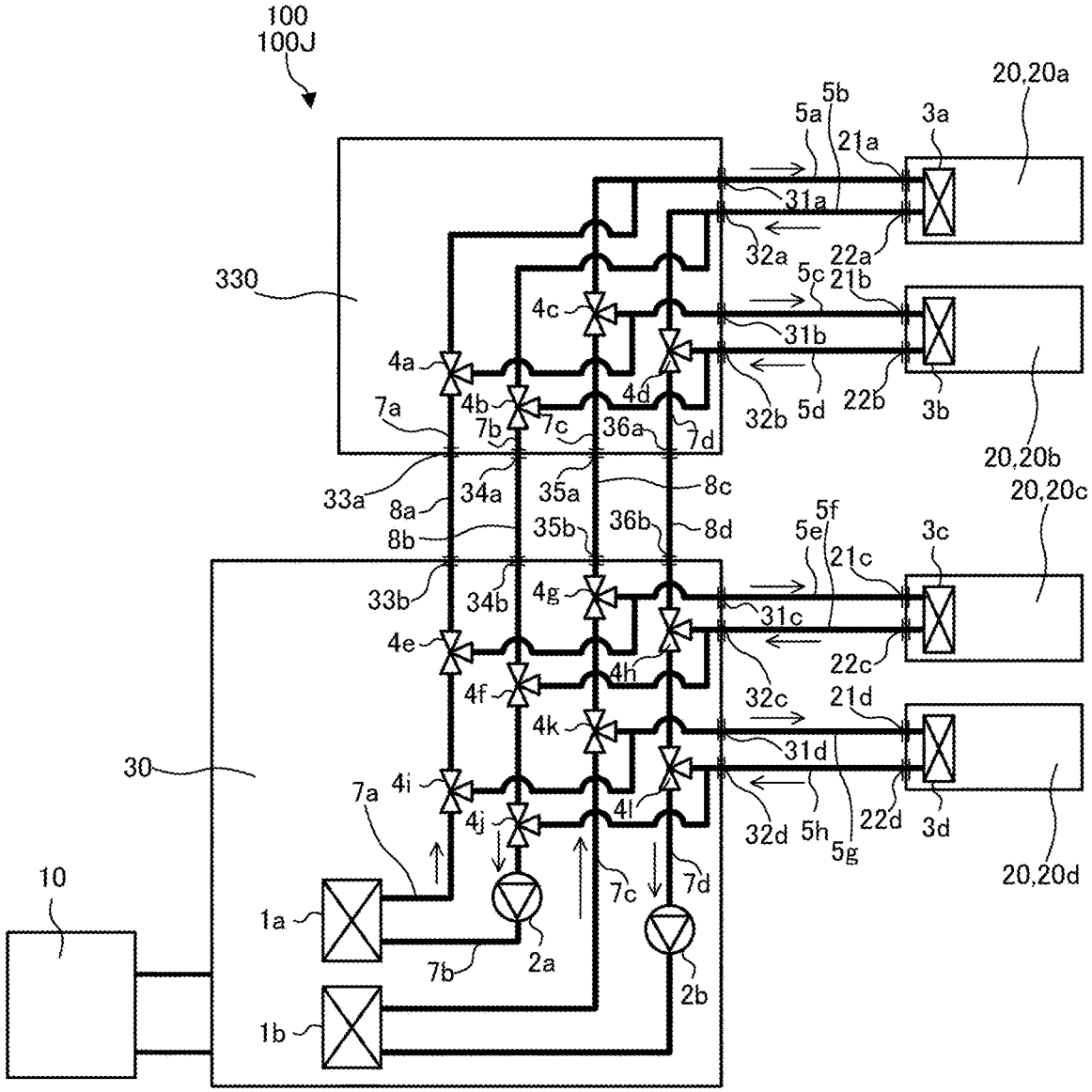
FIG. 12 is a circuit diagram of an air-conditioning apparatus 100J that is still another modification of the air-conditioning apparatus 100G according to Embodiment 3.

FIG. 12 is a circuit diagram of an air-conditioning apparatus 100J that is still another modification of the air-conditioning apparatus 100G according to Embodiment 3. In the air-conditioning apparatus 100J, the indoor units 20*c* and 20*d* are added to the air-conditioning apparatus 100I described above and are connected to the relay unit 30. In addition, in the air-conditioning apparatus 100J, elements closer to the indoor units 20*a* and 20*b* are removed from the branch portion 51*a*, the joining portion 52*a*, the branch portion 51*b*, and the joining portion 52*b* of the relay unit 30 of the air-conditioning apparatus 100F according to Embodiment 2 as illustrated in FIG. 8 and are used in the auxiliary relay unit 330.

The relay unit 30 and the auxiliary relay unit 330 of the air-conditioning apparatus 100J are connected by the intermediate pipes 8*a*, 8*b*, 8*c*, and 8*d* as in the air-conditioning apparatus 100I. The inside diameter Db of each of the intermediate pipes 8*a*, 8*b*, 8*c*, and 8*d* is set to an appropriate inside diameter based on the formula (1) as well as the inside diameter Dd of the intermediate pipes 8*a*, 8*b*, 8*c*, and 8*d* of the air-conditioning apparatus 100I.

The heat-medium conveying pipes 5*a*, 5*b*, 5*c*, 5*d*, 5*e*, 5*f*, 5*g*, and 5*h* of the air-conditioning apparatus 100J are set to satisfy the formula (1) as in Embodiments 1 and 2.

As described above, in the air-conditioning apparatuses 100H to 100J of the modifications, the inside diameter Db of each of the intermediate pipes 8*a*, 8*b*, 8*c*, and 8*d* which connect the relay unit 30 and the auxiliary relay unit 330 is set to an appropriate inside diameter on the basis of the formula (1), whereby it is possible to reduce the output of the pump while reducing the time required until the use-side heat exchangers 3 start appropriate heat exchange when the air-conditioning apparatuses 100H to 100J start operation or switch operations.

Also, in the air-conditioning apparatuses 100G to 100J according to Embodiment 3, the inside diameter of each of the internal pipes 7 in the relay unit 30 and the auxiliary relay unit 330 may be set to correspond to the inside diameter D of each of the heat-medium conveying pipes 5 or 6 as in Embodiment 1. In addition, each of the internal pipes 7 in the relay unit 30 and the auxiliary relay unit 330 may also be set to have an inside diameter based on the formula (1). The heat-medium conveying pipes 5 and 6 and the internal pipes 7 are each set to have an appropriate inside diameter D, whereby the air-conditioning apparatuses 100G to 100J can reduce the output of the pump while reducing the time required until the use-side heat exchangers 3 start appropriate heat exchange when the air-conditioning apparatuses 100G to 100J start operation or switch operations, and can thus improve the efficiency.

The invention claimed is:

1. An air-conditioning apparatus comprising:

a refrigerant cycle circuit in which a compressor, a heat-source-side heat exchanger, an expansion device, and a refrigerant-side flow passage of an inter-heat-medium heat exchanger are connected by refrigerant pipes, and refrigerant is circulated, the inter-heat-medium heat exchanger being configured to cause heat exchange to be performed between the refrigerant and a heat medium; and a heat-medium cycle circuit in which a pump, a use-side heat exchanger, and a heat-medium-side flow passage of the inter-heat-medium heat exchanger are connected by heat-medium conveying pipes, and the heat medium is circulated, wherein an inside diameter D of each of the heat-medium conveying pipes satisfies the following formula (1):

$$3(LQ2)0.2 < D < 104(Q/L)0.5, \quad (1)$$

where

D is a numerical value of the inside diameter expressed in mm,

Q is a numerical value of a capacity expressed in kW of the use-side heat exchanger connected to the heat-medium conveying pipes, and L is numerical value of a length expressed in m of at least one of the heat-medium conveying pipes included in the heat-medium cycle circuit, wherein a plurality of use-side heat exchangers including the use-side heat exchanger are provided, the heat-medium conveying pipes include a plurality of use-side pipes each connected to an associated one of the plurality of use-side heat exchangers, and a heat-source-side pipe connected to the inter-heat-medium heat exchanger, and of the inside diameters D of the heat-medium conveying pipes, an inside diameter Da of the heat-source-side pipe satisfies the formula (1), where a total capacity Qa of the plurality of use-side heat exchangers is substituted for the capacity Q and a length La of the heat-source-side pipe is substituted for the length L, and wherein the inside diameter Da of the heat-source-side pipe is larger than an inside diameter of each of the plurality of use-side pipes.

2. The air-conditioning apparatus of claim 1, wherein the plurality of use-side pipes branch off from the heat-source-side pipe.

3. The air-conditioning apparatus of claim 1, wherein the plurality of use-side heat exchangers include at least a first use-side heat exchanger, the plurality of use-side pipes include a first use-side pipe connected to the first use-side heat exchanger, and of the inside diameters D of the heat-medium conveying pipes, an inside diameter D1 of the first use-side pipe satisfies the formula (1), where a capacity Q1 of the first use-side heat exchanger is substituted for the capacity Q and a length L1 of the first use-side pipe is substituted for the length L.

4. The air-conditioning apparatus of claim 1, further comprising:

a heat source unit including at least the compressor and the heat-source-side heat exchanger; and a relay unit connected to the heat source unit by a pipe, and including at least the inter-heat-medium heat exchanger, wherein the plurality of use-side pipes each connect the relay unit and an associated one of the plurality of use-side heat exchangers.

5. The air-conditioning apparatus of claim 4, further comprising an auxiliary relay unit connected between the relay unit and the plurality of use-side heat exchangers, wherein the heat-medium conveying pipes further include an intermediate pipe connecting the relay unit and the auxiliary relay unit, and an inside diameter Db of the intermediate pipe satisfies the formula (1), where a total capacity Qb of the plurality of use-side heat exchangers connected to the auxiliary relay unit is substituted for the capacity Q and a length Lb of the intermediate pipe is substituted for the length L.

6. The air-conditioning apparatus of claim 5, wherein the auxiliary relay unit is connected to one or more of the plurality of use-side heat exchangers, the one or more of the plurality of use-side heat exchangers being different from one or more of the plurality of use-side heat exchangers that are connected to the relay unit.

7. The air-conditioning apparatus of claim 4, wherein a plurality of inter-heat-medium heat exchangers including the inter-heat-medium heat exchanger are provided, and each of the plurality of use-side heat exchangers is connected to an associated one of the plurality of inter-heat-medium heat exchangers.

8. An air-conditioning apparatus comprising:

a refrigerant cycle circuit in which a compressor, a heat-source-side heat exchanger, an expansion device, and a refrigerant-side flow passage of an inter-heat-medium heat exchanger are connected by refrigerant pipes, and refrigerant is circulated, the inter-heat-medium heat exchanger being configured to cause heat exchange to be performed between the refrigerant and a heat medium; and a heat-medium cycle circuit in which a pump, a use-side heat exchanger, and a heat-medium-side flow passage of the inter-heat-medium heat exchanger are connected by heat-medium conveying pipes, and the heat medium is circulated, wherein an inside diameter D of each of the heat-medium conveying pipes satisfies the following formula (1):

$$3(LQ^2)^{0.2}<D<104(Q/L)^{0.5} \quad (1),$$

where

D is a numerical value of the inside diameter expressed in mm,

Q is a numerical value of a capacity expressed in kW of the use-side heat exchanger connected to the heat-medium conveying pipes, and L is numerical value of a length expressed in m of at least one of the heat-medium conveying pipes included in the heat-medium cycle circuit, wherein a plurality of use-side heat exchangers including the use-side heat exchanger are provided, the heat-medium conveying pipes include a plurality of use-side pipes each connected to an associated one of the plurality of use-side heat exchangers, and a heat-source-side pipe connected to the inter-heat-medium heat exchanger, and of the inside diameters D of the heat-medium conveying pipes, an inside diameter Da of the heat-source-side pipe satisfies the formula (1), where a total capacity Qa of the plurality of use-side heat exchangers is substituted for the capacity Q and a length La of the heat-source-side pipe is substituted for the length L, further comprising:

a heat source unit including at least the compressor and the heat-source-side heat exchanger; and a relay unit connected to the heat source unit by a pipe, and including at least the inter-heat-medium heat exchanger, wherein the plurality of use-side pipes each connect the relay unit and an associated one of the plurality of use-side heat exchangers; and an auxiliary relay unit connected between the relay unit and the plurality of use-side heat exchangers, wherein the heat-medium conveying pipes further include an intermediate pipe connecting the relay unit and the auxiliary relay unit, and an inside diameter Db of the intermediate pipe satisfies the formula (1), where a total capacity Qb of the plurality of use-side heat exchangers connected to the auxiliary relay unit is substituted for the capacity Q and a length Lb of the intermediate pipe is substituted for the length L, wherein the inside diameter Db of the intermediate pipe is larger than an inside diameter of each of the plurality of use-side pipes.

* * * * *